United States Patent [19]

Mayer et al.

[11] 4,427,756

[45] Jan. 24, 1984

[54] DEVELOPER CROSSMIXING METHOD

[75] Inventors: Edward F. Mayer; Donald F. Pfeuffer, both of San Jose, Calif.

[73] Assignee: Ricoh Company, Ltd., Japan

[21] Appl. No.: 368,633

[22] Filed: Apr. 15, 1982

Related U.S. Application Data

[62] Division of Ser. No. 120,907, Feb. 12, 1980, Pat. No. 4,361,109.

[51] Int. Cl.[3] ..... G03G 13/08; G03G 13/09

[52] U.S. Cl. ..... 430/121; 430/122

[58] Field of Search ..... 355/3 DD; 118/653, 655, 118/656, 657, 658; 430/120–122, 123

[56] References Cited

U.S. PATENT DOCUMENTS 3,943,887 3/1976 Smith ..... 118/658 X 4,075,977 2/1978 Williams ..... 118/658

*Primary Examiner*—Evan K. Lawrence

*Attorney, Agent, or Firm*—Guy W. Shoup; Robert Scobey

[57] ABSTRACT

A crossmixing method for ensuring adequate mixing of a developer in an electrostatic printing machine. The method utilizes a screw conveyor having a left-hand thread on one portion thereof and a right-hand thread on another portion thereof, to move developer material from the end of the screw conveyor toward the middle thereof. Material is discharged from the screw conveyor into the sump of the machine in a direction generally toward the opposite end of the screw conveyor from where it originated. Developer material is moved from the sump upwardly onto a plate assembly which includes angled separators for guiding the developer particles and shifting them in opposite lengthwise senses on opposite halves of the plate assembly. From the plate assembly, the developer material moves in a curtain downwardly into the sump.

4 Claims, 5 Drawing Figures

DEVELOPER CROSSMIXING METHOD

This is a division, of application Ser. No. 120,907 filed Feb. 12, 1980, U.S. Pat. No. 4,361,109.

BACKGROUND AND BRIEF DESCRIPTION OF THE INVENTION

This invention relates to crossmixing methods for ensuring adequate mixing of developer particles in an electrostatic printing machine.

The development of electrostatic images is well known in the art, and is most often accomplished by employing a two component developer consisting of a larger particle called a carrier, ranging upwardly from 75 micron, and a smaller particle, called toner, usually about 5 to 10 microns in diameter. These two particles are selected to that their surfaces interact triboelectrically to create the proper sign of charge on the toner particle necessary for development of the image. In some development systems, additives may be added to the toner consisting of agents for modifying the charge, assisting in the cleaning, and reducing Van der Wahl forces between the toner and carrier.

Two methods of carrier development are in common use today. These are magnetic brush development and cascade development. The primary difference between the two development systems is the motive force for bringing the developer into contact with the latent electrostatic image. In the case of a magnetic brush system, the force is magnetic and this requires that the carrier be magnetic. In the case of cascade, the carrier has no such requirement but in many cases it may be magnetic.

In the operation of these development systems, it is required that the composition of the developer be uniform throughout the developer system in order that the density of the copy is uniform across the surface. Since, in the operation of the machine, the image area is not uniformly distributed across the surface of the copy, consumption of the toner is not uniform across the width of the developer unit. In more complex developers (those consisting of more than 2 discrete components), the problem may be further complicated by the components not being consumed at similar rates; in addition to the toner/carrier ratio changing, the amount of additive or additives at various points across the developer roll may vary and affect the performance. Many methods have been proposed to correct this problem, two examples being presented in U.S. Pat. Nos. 3,707,947 and 3,724,422. The method used in both of these developer systems is a series of oppositely sloped channels through which the developer flows. These channels are arranged to move one half of the developer flow in one direction, side to side, while the other half moves in the opposite direction. These systems rely entirely on gravity to accomplish this side to side motion. In addition to this side to side motion, the flow in these diverters serves to agitate the developer and stabilize the triboelectric charging.

A simpler method of mixing and stirring the developer is shown in U.S. Pat. No. 3,575,139, and consists of a pair of augers positioned in the developer sump and driven so as to move them in opposite directions. This latter method causes high shear forces to develop in the sump area and can materially shorten the life of the developer.

The present invention is a method wherein mechanical movement and mixing of developer particles is achieved through use of a single screw conveyor having both left-hand and right-hand threads. In this fashion particles of developer material move in opposite directions along the screw conveyor. Advantageously, developer material is introduced at opposite ends into the screw conveyor and is moved therealong to the mid-section thereof, from whence it is discharged in a direction toward the opposite end of the screw conveyor. It discharges into the sump of the printing machine, from which the particles are removed by conventional magnetic brushes and deposited upon a plate assembly. The plate assembly includes separators for guiding the developer particles, and the separators are angled in one direction on one lengthwise portion of the plate assembly and in another direction on another lengthwise portion, so as to shift particles of developer material in opposite lengthwise senses on the two portions of the plate assembly. The plate assembly is positioned over the screw conveyor, and includes openings adjacent opposite ends of the conveyor so that particles of developer material on the plate assembly drop directly into the screw conveyor and are conveyed along the conveyor as just described. The remainder of the particles on the plate assembly, being shifted as just described, cascade downwardly from that assembly in a curtain into the sump of the printing machine from which they are removed by the magnetic brushes.

By this action, a developer particle moving continuously through the system may be considered as moving in a helical path commencing from a mid-section of the printing machine to one end thereof, at which point it enters the screw conveyor and moves into the central portion of the sump, being directed toward the opposite end of the machine. At this central portion of the sump the particle is again moved in a helical path toward the opposite end of the machine, being deposited this time at the opposite end of the screw conveyor in which it moves to the central part of the sump to continue again in the helical path it initially took.

Tests were performed with a system embodying the present invention with an unbalanced developer, loading 3% concentration developer in one side and 1% concentration in the other and sampling the developer after 1 minute, 2 minutes and 3 minutes of running time. After 3 minutes of running time, the toner concentration was uniform across the unit. In imaging tests in an unbalanced operation (imaging on only 8% of the width of the unit), the toner concentration in the unused section of the developer has varied no more than 2% to 3% of the total toner concentration at a level of 2%. The density reproduction of the copy across the unit was no more than 0.05 units at a 2.0 optical density level. In this test, the developer contained a toner with three discrete components, and all components of the toner and carrier were maintained in the proper ratios throughout the developer unit.

The mixing and transporting action of the screw conveyor handles only about 10% of the developer at one time. This small percentage in the screw conveyor reduces the "wear" generated by the system. In experiments performed, the developer life has not been found to be reduced by such a crossmixer system, and in one series of experiments an experimental developer has produced 80,000 copies with not evidence of failure with a charge of only 4 pounds of developer. This compares well with some prior art systems in which 20 pounds of developer provides approximately 200,000 copies.

The invention will be more completely understood by reference to the following detailed description, taken in conjunction with the appended drawings.

DETAILED DESCRIPTION

Figure 1:
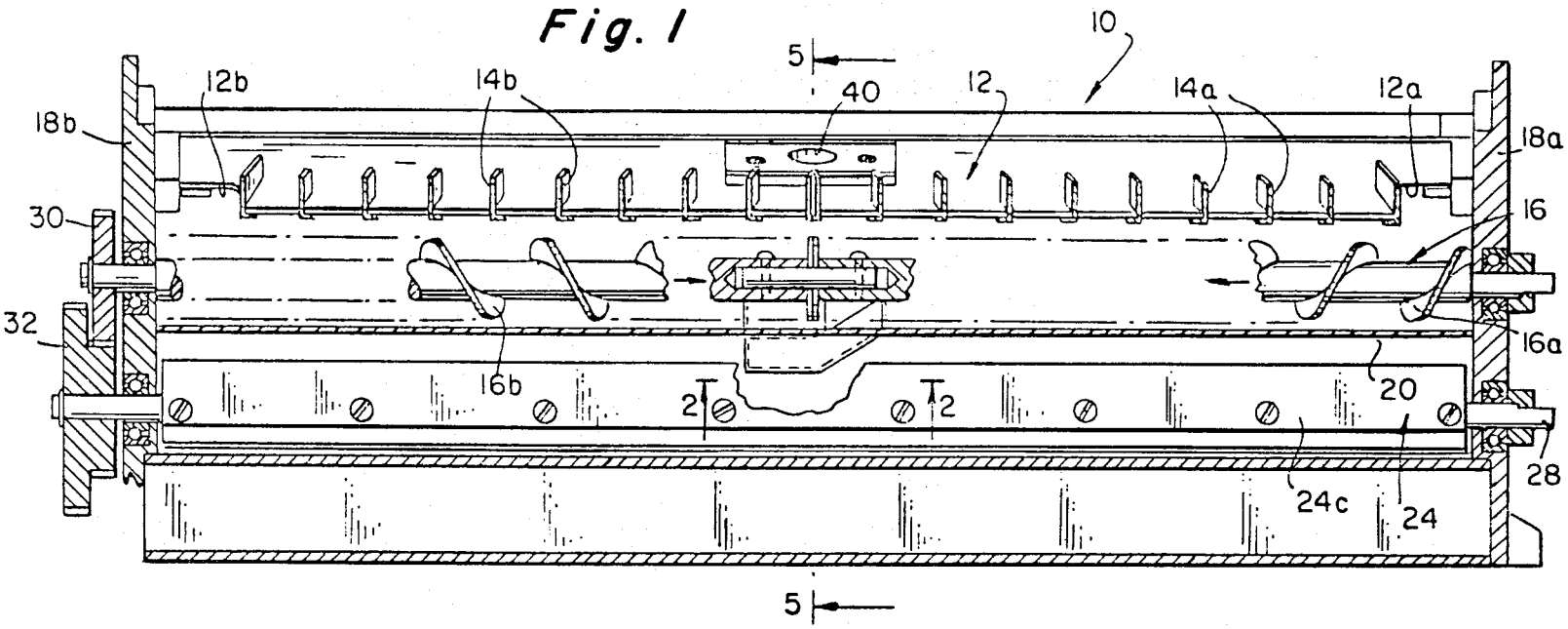
FIG. 1 is a sectional view of a crossmixing device embodying the invention.
Figure 2:
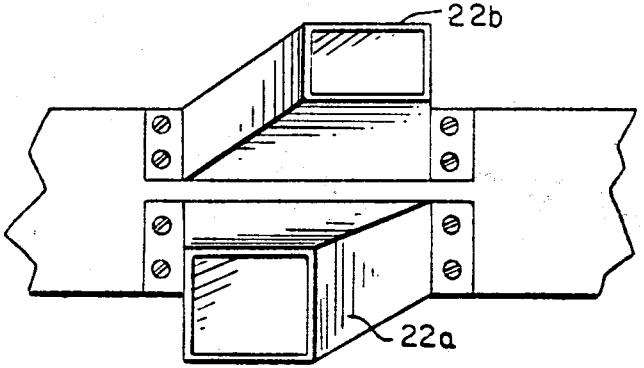
FIG. 2 is a view looking in the direction of the arrows 2—2 in FIG. 1 (to an enlarged scale), showing exit chutes from the screw conveyor of FIG. 1.
Figure 3:
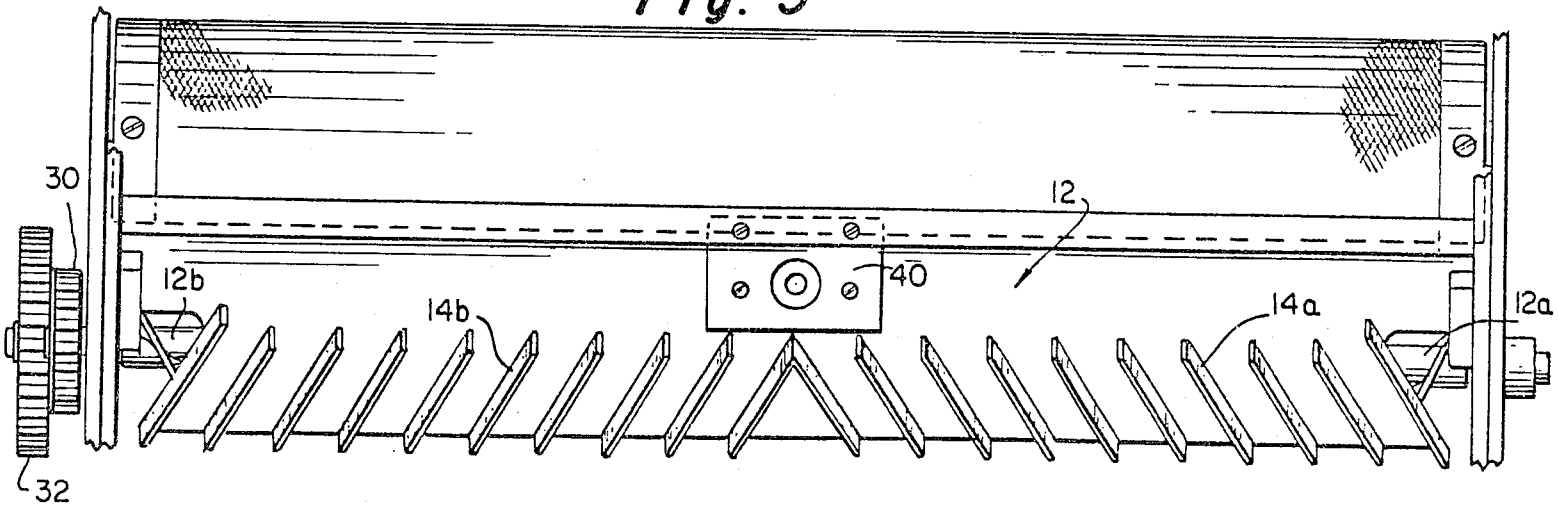
FIG. 3 is a top, plan view of the device of FIG. 1.

Referring to FIG. 1, a crossmixing device 10 is shown. It includes a plate assembly 12 (also known as a "scraper" assembly), which has mounted thereon a plurality of separators 14*a* and 14*b*. The separators 14*a* on the right-hand side of the device in FIG. 1 are angled slightly to the right, while those on the left-hand side (14*b*) are angled slightly to the left. As particles of developer material flow down over the plate assembly 12, they are guided by the separators 14*a* and 14*b* so that the particles of developer material on the right-hand side of the plate assembly are shifted slightly to the right, while those particles on the left-hand side of the plate assembly 12 are shifted slightly to the left. The angling of the separators 14*a* and 14*b* is perhaps more clearly shown in FIG. 3.

Figure 5:
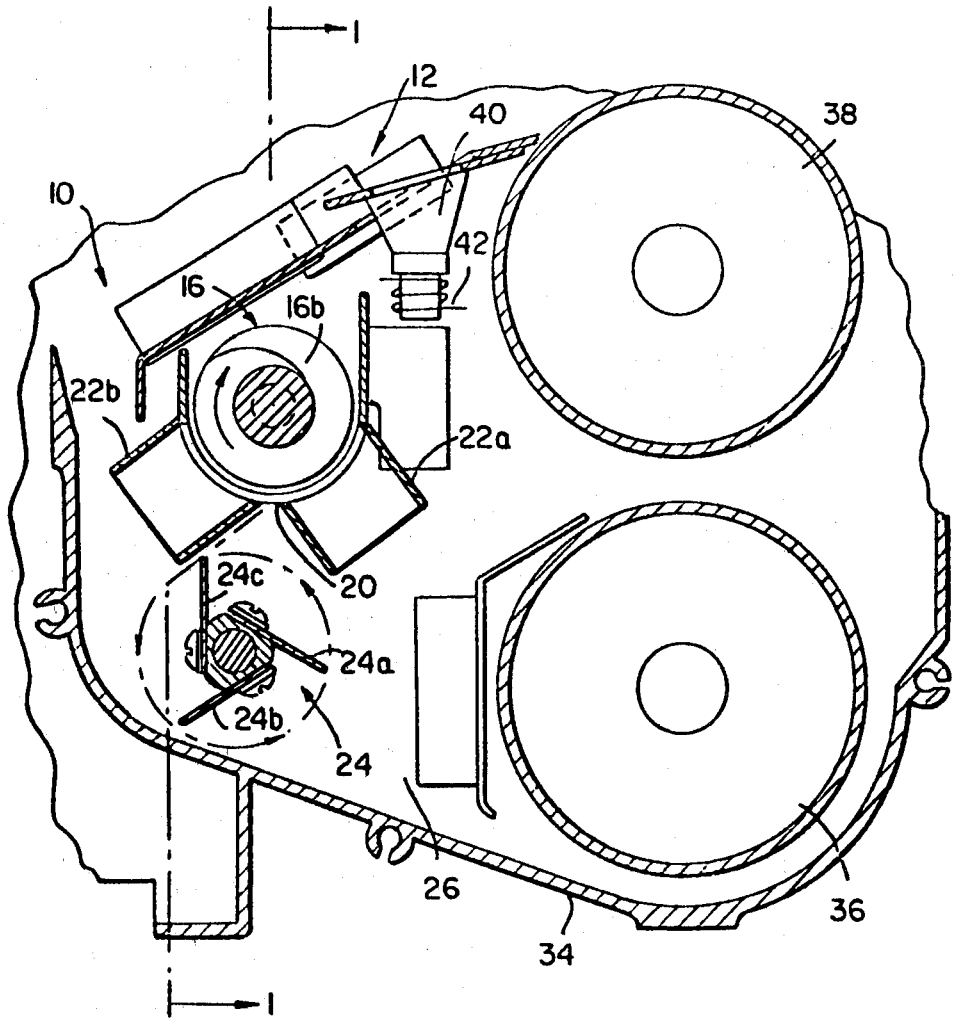
FIG. 5 is a transverse sectional view of a developing system for an electrostatic printing machine, that includes the crossmixing device of FIG. 1, and is generally taken along the section 5—5 in FIG. 1.

The plate assembly includes openings 12*a* and 12*b* therein for providing communication with a screw conveyor 16 mounted beneath the plate assembly 12. The openings 12*a* and 12*b* are at opposite ends of the plate assembly, over opposite ends of the screw conveyor 16. The screw conveyor 16 is a single screw conveyor journalled for rotation in end walls 18*a* and 18*b*. However, that conveyor includes a left-hand flight 16*a* on the right-hand portion thereof, and a right-hand thread flight 16*b* on the left-hand portion thereof. The screw conveyor 16 is surrounded by a trough 20. The screw conveyor 16 is rotated in a clockwise sense, as shown in FIG. 5.

Because of the use of right-hand and left-hand threads on the single screw conveyor 16, particles of developer material are moved in opposing directions along the screw conveyor. Specifically, particles of developer material passing downwardly through the opening 12*a* in the plate assembly 12 move from the right-hand end of the screw conveyor along that screw conveyor to the mid-portion thereof; particles of developer material passing through the opening 12*b* at the left-hand end of the screw conveyor are moved from that end of the conveyor to the mid-portion of the conveyor. The developer material in the mid-section of the screw conveyor exits from the trough 20 via exit chutes 22*a* and 22*b*. Specifically, exit chute 22*a* communicates with conveyor section 16*a* and takes developer particles moving from the right to the left in FIG. 1 in the screw conveyor and deposits them into the sump of the machine in a direction toward the other end of the conveyor. Similarly, exit chute 22*b* communicates with the conveyor section 16*b*, and discharges particles of developer material moving from left to right in FIG. 1 into the machine sump and toward the opposite end of the screw conveyor. As shown in FIG. 5, rotating vane assembly 24 is located within the sump 26 of the machine. The rotating vane assembly is conventional, and includes vanes 24*a*, 24*b*, and 24*c* mounted on a shaft 28 journalled for rotation in end plates 18*a* and 18*b*. The screw conveyor 16 and the rotating vane assembly 24 may be coupled together by gears 30 and 32, shown in FIG. 1.

Within the sump 26 of the machine, the rotating vane assembly 24 moves the material along lower wall 34 of the device so that it is picked up by rotating magnetic brush assembly 36, and thence transferred to rotating magnetic brush assembly 38 from which the particles of material are transferred to the plate or scraper assembly 12 to flow by gravity along the inclined surface of that plate assembly to be engaged by the separators 14*a* and 14*b*, as described above. From that plate or scraper assembly, the material cascades downwardly in a curtain back into the sump 26. As shown in FIG. 5, the plate assembly 12 may include a monitoring chute 40 (see also FIG. 1) that diverts a small quantity of developer material from the plate or scraper assembly 12 and causes it to pass between a coil 42 used for monitoring purposes to determine the electromagnetic characteristics of the developer material.

Figure 4:
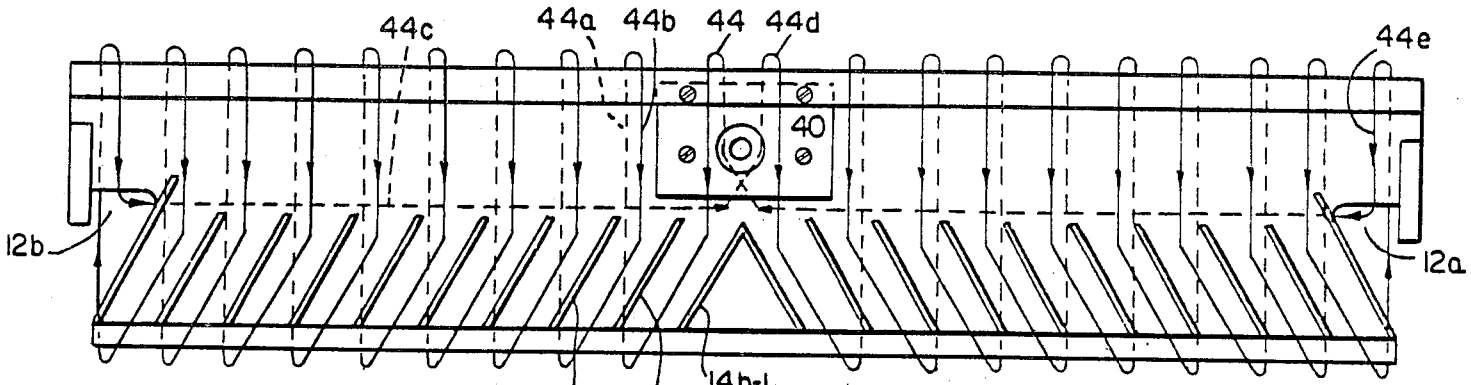
FIG. 4 is a view similar to that of FIG. 3, showing the path of a hypothetical particle of developer material moving through the crossmixing device.

Referring to FIG. 4 and considering the movement of a hypothetical particle which stays within the system and moves continuously, the particle may be considered to commence its movement as at 44 in the mid-section of the device just to the left of the monitoring chute 40. The particle passes downwardly over the plate or scraper assembly 12 as shown by the arrow, and passes between separators 14*b*-1 and 14*b*-2. In so passing, it is shifted slightly to the left in FIG. 4. Then the particle moves downwardly into the sump 26 of the machine where it is picked up by the magnetic brushes 36 and 38 (as represented by the dashed line segment 44*a*) and is returned again to the top of the plate assembly 12 and moves downwardly therealong, as represented by the line segment 44*b*, this time to pass between the separators 14*b*-2 and 14*b*-3. The particle thus follows a generally helical path through the device from the mid-section thereof to the left-hand end (as viewed in FIG. 4), until it reaches the opening 12*b*. At that point the particle passes into the screw conveyor system and is conveyed from left to right as designated by arrow 44*c*. When it reaches the mid-section of the screw conveyor, it passes downwardly through the exit chute 22*b*, as described above, and enters into the sump, from whence it is conveyed upwardly, as designated by arrow 44*d* and onto the right-hand plate assembly section. The particle then follows a generally helical path through the right-hand portion of the device, until it reaches the right-hand end thereof and passes downwardly through the opening 12*a* (as shown by arrow 44*e*) and again passes into the screw conveyor system 16. In this case, the particle is at the right-hand end of the screw conveyor, and moves from that end to the left toward the center thereof where it is discharged through the exit chute 22*a*, to continue the process as described above.

As has been noted above, this movement of particles throughout the system is very effective in mixing the particles to ensure a uniform distribution throughout the entire system.

A presently preferred embodiment of the invention has been described. It is apparent that modifications may be made in this presently preferred embodiment. Accordingly, the invention should be taken to be defined by the following claims.

We claim:

1. In a method of moving particles of developer material in an electrostatic printing machine to ensure adequate mixing thereof, including forming a curtain of the material and cascading it downwardly into a sump from whence the particles are raised upwardly to be formed again into said curtain, and deflecting the particles so that one portion of said particles are shifted in one lengthwise sense along a lengthwise portion of said curtain and another portion of said particles are shifted along another lengthwise portion of said curtain in an opposite lengthwise sense just prior to said forming of said curtain, the improvement in which certain of said particles adjacent each portion of said curtain are removed prior to said formation of said curtain and are moved to a section of said sump below the other portion of said curtain.

2. A method according to claim 1, in which said particles are deflected so that they are shifted outwardly along each portion of said curtain from a mid-section of said curtain, and said removed particles are removed adjacent opposite ends of said curtain and are moved to a mid-section of said sump.

3. A method according to claim 2, in which said moved particles are directed into said mid-section of said sump in a direction toward the opposite end of said curtain from whence said moved particles originated.

4. A method according to claim 1, in which said removed particles are removed at the terminus of shifting movement along each portion of said curtain and are moved to a section of said sump below the beginning of shifting movement along the other portion of said curtain.

* * * * *